US007412068B2

(12) United States Patent
Bayer

(10) Patent No.: US 7,412,068 B2
(45) Date of Patent: Aug. 12, 2008

(54) OTOPLASTY FOR BEHIND-THE-EAR (BTE) HEARING AIDS

(76) Inventor: Erich Bayer, Straubing (DE)

( * ) Notice: Subject to any disclaimer, the term of this patent is extended or adjusted under 35 U.S.C. 154(b) by 0 days.

(21) Appl. No.: 11/678,340

(22) Filed: Feb. 23, 2007

(65) Prior Publication Data

US 2007/0133835 A1 Jun. 14, 2007

Related U.S. Application Data

(60) Division of application No. 10/790,126, filed on Mar. 2, 2004, now Pat. No. 7,233,676, which is a continuation of application No. 10/030,191, filed as application No. PCT/EP00/10109 on Oct. 13, 2000, now abandoned.

(30) Foreign Application Priority Data

Oct. 14, 1999 (DE) ..... 299 18 139 U
Jun. 2, 2000 (DE) ..... 200 09 908 U

(51) Int. Cl.
*H04R 25/00* (2006.01)

(52) U.S. Cl. ..... 381/328; 381/380; 381/382

(58) Field of Classification Search ..... 381/322, 381/330, 324–328, 380–382; 181/129, 130, 181/135; 600/25, 559; 607/56, 57
See application file for complete search history.

(56) References Cited

U.S. PATENT DOCUMENTS

| | | | | |
|---|---|---|---|---|
| 1,614,987 | A | 1/1927 | Langebeck et al. | |
| 1,668,890 | A | 5/1928 | Curran et al. | |
| 1,668,910 | A | 5/1928 | Jones | |
| 1,953,437 | A * | 4/1934 | Schier | 181/135 |
| 2,545,731 | A | 3/1951 | French | |
| 2,763,334 | A | 9/1956 | Starkey | |
| 2,874,231 | A | 2/1959 | Wallace | |
| 2,939,923 | A | 6/1960 | Henderson | |
| 3,041,856 | A | 7/1962 | Neal | |
| D221,442 | S | 8/1971 | Feingold | |
| 5,048,090 | A | 9/1991 | Geers | |
| 5,677,964 | A * | 10/1997 | Sun | 381/385 |
| 6,094,492 | A | 7/2000 | Boesen | |
| 7,027,608 | B2 | 4/2006 | Fretz et al. | |
| 2002/0096391 | A1 | 7/2002 | Smith et al. | |
| 2001/0172386 | | 11/2002 | Bayer | |

(Continued)

FOREIGN PATENT DOCUMENTS

| | | |
|---|---|---|
| DE | 38 26 897 | 3/1989 |

(Continued)

*Primary Examiner*—Huyen D Le
(74) *Attorney, Agent, or Firm*—Oblon, Spivak, McClelland, Maier & Neustadt, P.C.

(57) ABSTRACT

An otoplastic for production of behind-the-ear hearing aids. The hearing aid includes a preferably flexible signal conductor, such as e.g. an acoustic tube positioned in the auditory canal, whereby the otoplastic matches the individual anatomy of the patient and its locating part is in the form of a clip, which, at least partly arched, follows the outer edge of the cavum conchae. A branch which following the edge of the cavum conchae transforms, above the antitragus, into a bent crosspiece traversing the cavum conchae and extending in the direction of the porus acusticus externus. The end section of said crosspiece lies in the upper section of the auditory canal and widens to accept the signal conductor.

5 Claims, 13 Drawing Sheets

U.S. PATENT DOCUMENTS

| | | | |
|---|---|---|---|
| 2002/0172386 | A1 | 11/2002 | Bayer |
| 2003/0112992 | A1 | 6/2003 | Rapps |
| 2005/0111686 | A1 | 5/2005 | Bayer |

FOREIGN PATENT DOCUMENTS

| | | | |
|---|---|---|---|
| DE | 298 01 567 | | 5/1998 |
| DE | 297 18 483 | | 4/1999 |
| DE | 10050766 | A1 | 5/2001 |
| DE | 10111467 | A1 | 1/2002 |
| EP | 0 836 364 | | 4/1998 |
| JP | 74473 | | 11/1927 |
| JP | 58-104077 | | 7/1983 |
| JP | 60-40187 | | 3/1985 |
| JP | 2001333484 | A | 11/2001 |
| JP | 2002058086 | A | 2/2002 |
| WO | WO 98/31193 | | 7/1998 |

* cited by examiner

OTOPLASTY FOR BEHIND-THE-EAR (BTE) HEARING AIDS

BACKGROUND OF THE INVENTION

1. Field of the Invention

The invention relates to an ear fitting piece, i.e. an earpiece for behind-the-ear (BTE) devices in the field of hearing acoustics. These devices are also frequently referred to as BTE-secret-ears (SE). In this connection, a relatively short sound tube is used, making it possible to noticeably reduce friction losses, particularly in the high-frequency sonic range.

2. Discussion of the Background

However, the sound tube must, be precisely positioned in or on the auditory canal, and for this purpose, an ear fitting piece, i.e. an earpiece is regularly used, which is individually adapted to the human anatomy of the ear of the patient to be treated. Up to the present date, various forms of earpieces have become common, with some, namely the so-called "open" BTE earpieces, being particularly preferred, in order to have the minimum possible effect on the auditory canal, caused by partially covering or closing it off in some regions, with a "foreign body." These "open" BTE devices have the further advantage that the hearing capacity that still exists is impaired as little as possible in terms of its natural effect.

Known relevant earpieces are known as "SE shell shape, SE clip shape, or SE claw shape" (See Ulrich Voogdt: Otoplastik—Die individuelle Otoplastik zur Hörgeräte-Versorgung . . . [Earpieces—Individual earpieces for hearing aids . . . ], Volume 2 of the scientific series "Akademie für Hörgeräte-Akustik" [Academy for hearing device acoustics), Median-Verlag of Killisch-Horn GmbH, 1993). A modified version of these common earpieces is the "open" solution. However, all of the variants have the common feature that it is frequently not possible to make the hearing correction as natural as possible.

SUMMARY OF THE INVENTION

It is therefore the task of the invention to create an earpiece for an "open" BTE hearing aids, for CI components (cochlear implant microphone systems and CI BTE processors), or BTE tinnitus systems, which are characterized not only by a minimal feeling of wearing a foreign body, and good wearing comfort, but primarily in that natural sound processing in the human ear can be utilized with as little distortion as possible, in order to ensure a maximum degree of hearing correction and sense of natural hearing.

This task is accomplished by an earpiece according to the present invention.

With the earpiece according to the invention it is possible to keep the auditory canal open at the decisive points, to a degree that has not been achieved until now. The invention is based on the consideration that the sense of natural hearing, on the one hand, and the effectiveness of the hearing correction, on the other hand, are significantly influenced by the anatomically determined, natural resonance conditions in the auditory canal, including the external ear. Using the structure of the earpiece according to the invention, the natural resonance remains largely unaffected, even if the auditory canal is very narrow. In this connection, there are the additional advantages that the wearing comfort is extremely good (material-free region in the region of the crus helicis; no accumulation of heat), that the earpiece requires very little material and therefore also has cosmetic advantages, and that acoustic coupling for influencing the frequency and the dynamics can take place more free of complications.

Although the earpiece according to the invention takes up less room, it can reliably fulfill the function of stabilizing the sound tube, in that the coupling between the sound tube and the BTE device is utilized for stabilization.

It has been shown that the support elements of the earpiece are positioned in such a stable manner, in spite of the reduced contact area with the cavum conchae, that the end segment of the earpiece traverse part can carry an auditory canal tab, in accordance with the further development in Claim 2, making it possible to achieve better support in the auditory canal.

The task stated above is accomplished in accordance with a second alternative in that the earpiece is, for the first time, positioned at a location of the external ear that lies entirely outside of the cavum conchae. It has surprisingly been shown that when positioning the part of the earpiece that provides the hold in the cymba, it is easily possible, in interaction with the inherent stability of the flexible signal conductor or the sound tube, to precisely and reproducibly position the latter in the auditory canal, which is no longer blocked off by an earpiece component, according to the invention. In this way, this earpiece is particularly well suited, in addition to "open" standard applications, for applications in children with deafness in one ear, or, for example, for students with normal hearing but with a so-called reading/spelling weakness, in connection with so-called FM (frequency modulation) systems in which the teacher's speaking signal is fed into the auditory canal of the hearing-challenged child via a microphone and a microport system. Particularly in this case, utilization of the natural auditory canal resonance is very important, and this is achieved by the earpiece according to the invention, to a degree that has not been achieved until now. Because of the improved general conditions, it is furthermore easier to undertake acoustical coupling of the hearing device to the frequency and dynamics influencing system, so that the earpiece according to the invention is also well suited for use in media, e.g. during live television interviews, as a type of "in-ear monitoring," where in this case, a simultaneous translation, for example, or the voice signal of a prompter, are tea into the auditory canal under the most natural conditions possible.

A particular advantage of the earpiece according the present invention can be seen in that there is great freedom with regard to the structure of the clip that goes around the external ear in the shape; of an arc, which in turn can be utilized for additional stabilization of the earpiece.

If the main body of the earpiece that provides the hold is extended into the region of the crus anthelicis, stabilization of the main body is further improved, which makes it possible to further reduce the size of the main body. At the same time, this improves the wearing comfort, and it also has advantages in terms of cosmetics.

This embodiment, just like the first embodiment, has the advantage that it can be used without complications for specific special applications, such as a very narrow auditory canal or a lot of hair at the end of the auditory canal, or other anomalies of the ear anatomy.

Further developments of the invention are described hereafter in the specification and claims.

BRIEF DESCRIPTION OF THE DRAWINGS

In the following, exemplary embodiments of the invention will be explained in greater detail, using the schematic drawings. These show.

DETAILED DESCRIPTION OF THE PREFERRED EMBODIMENTS

Figure 1:
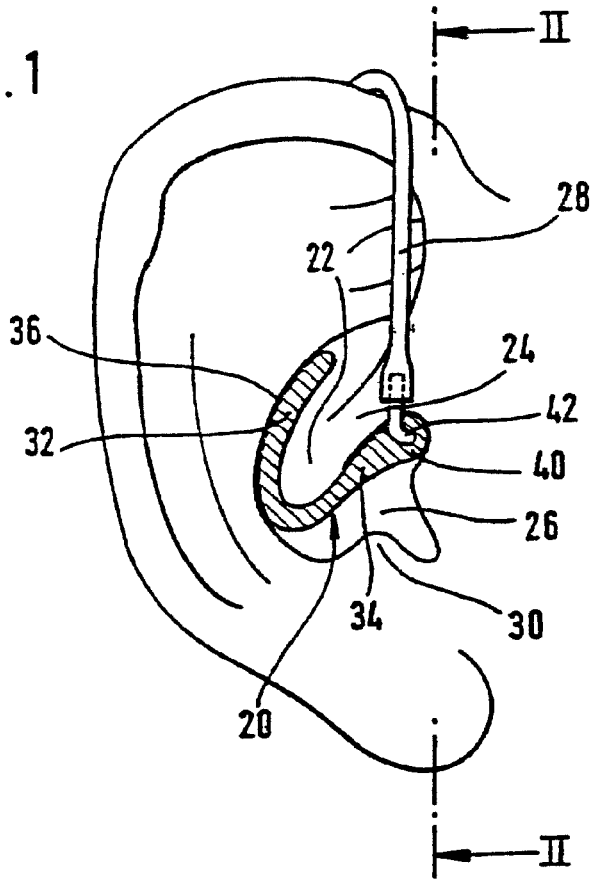
FIG. 1 is a view of an ear from the side, with the earpiece according to the first embodiment inserted in, it.

FIG. 1 shows an earpiece, with the reference number 20, for a BTE device, which is used in the cavum conchae, referred to with the reference number 22. The crus helicis is referred to with the reference number 24, and the auditory canal, i.e. the meatus acusticus externus, is referred to with reference number 26.

The earpiece serves to stabilize a sound tube 28 that leads to the BTE device, not shown, which tube opens into the auditory canal. For this purpose, the earpiece is individually adapted to the anatomy of the patient, for example by means of an impression-taking procedure. It essentially has the shape of a clip with two shanks 32, 34. The first shank extends in an arc shape along the outer edge 36 of the cavum conchae 22 up to a point above the antitragus, referred to as 30. From there, the earpiece runs at an angle, upward, via a second shank that passes through the cavum conchae, which will be referred to as the traverse segment 34 in the following discussion. The traverse segment runs in the direction of the porus acusticus externus 38 and there widens to an end segment 40, which serves to hold the signal conductor, in the case shown here, a sound tube angle piece 42.

Figure 2:
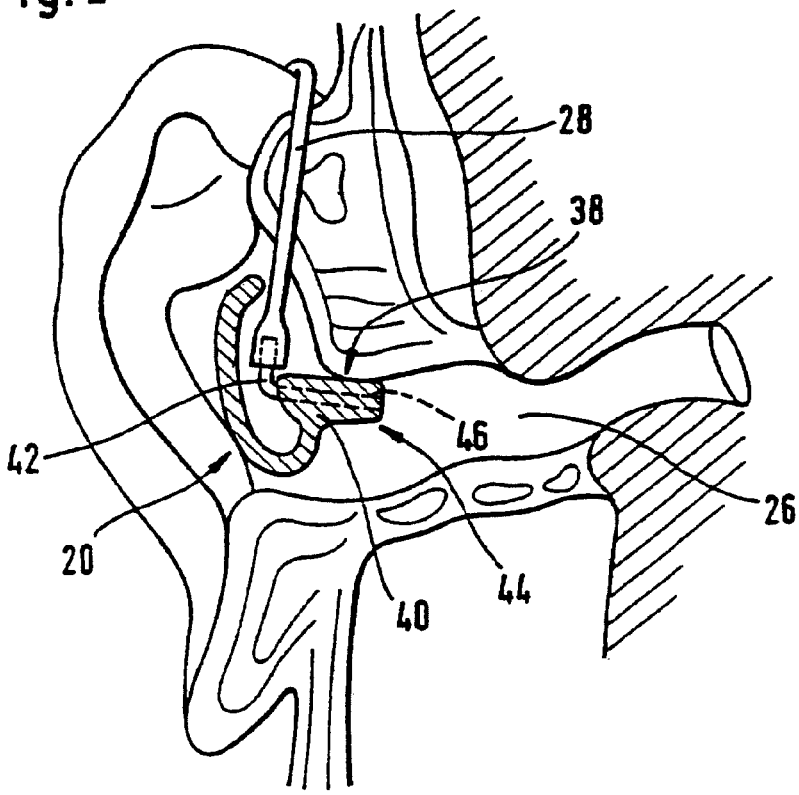
FIG. 2 is a cross-sectional view taken along line II-II in FIG. 1.

As is evident from FIG. 2, the end segment 40 makes a transition into an acoustical canal tab 44 in which a bore 46 (shown with broken lines) is formed.

From the drawing, it is evident that the earpiece covers the auditory canal 26 only slightly, so that the natural auditory canal/external ear resonance is maintained. Additional stabilization of the earpiece 20 is achieved with the sound tube 28, which is rigidly connected with the angle piece 42.

Figure 3:
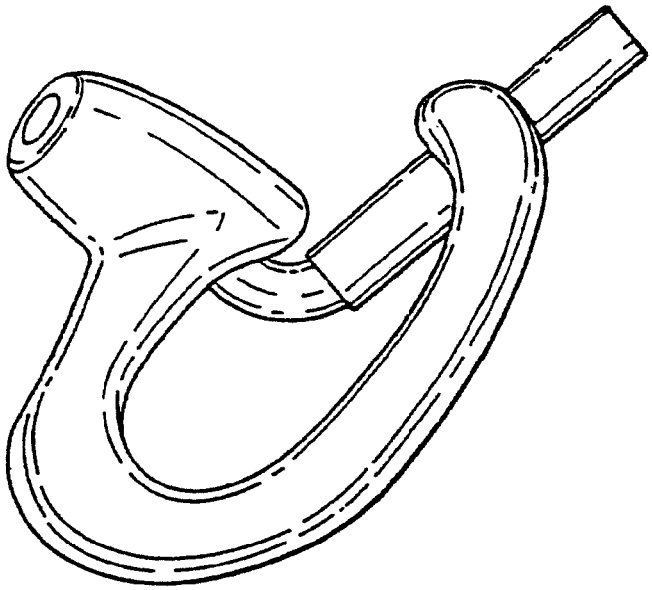
FIG. 3, and FIG. 4 on a larger scale, illustrate representations of an actual manufactured earpiece of the embodiment according to FIGS. 1 and 2.
Figure 4:
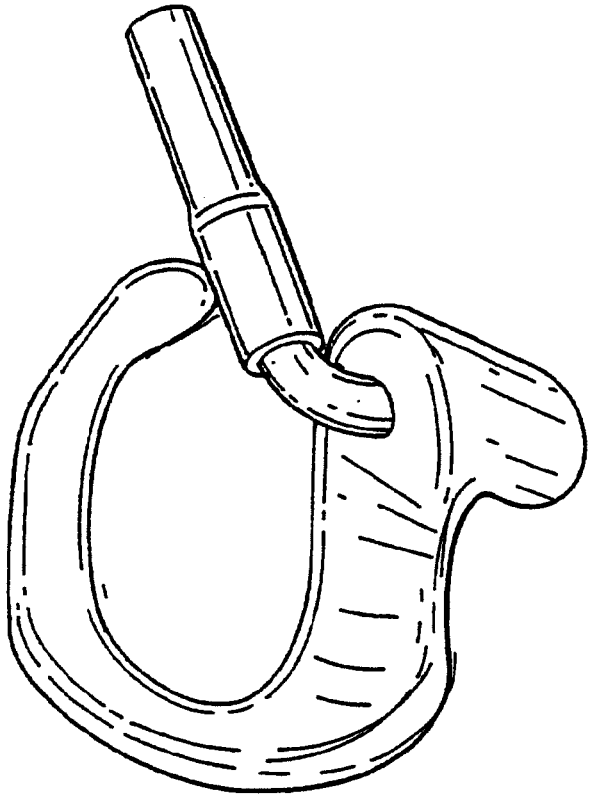

In FIGS. 3 and 4, which show an earpiece according to FIGS. 1 and 2, made of plastic, the filigree structure is clearly evident, but nevertheless the earpiece can be fixed in place in the cavum conchae, in stable manner.

Figure 5:
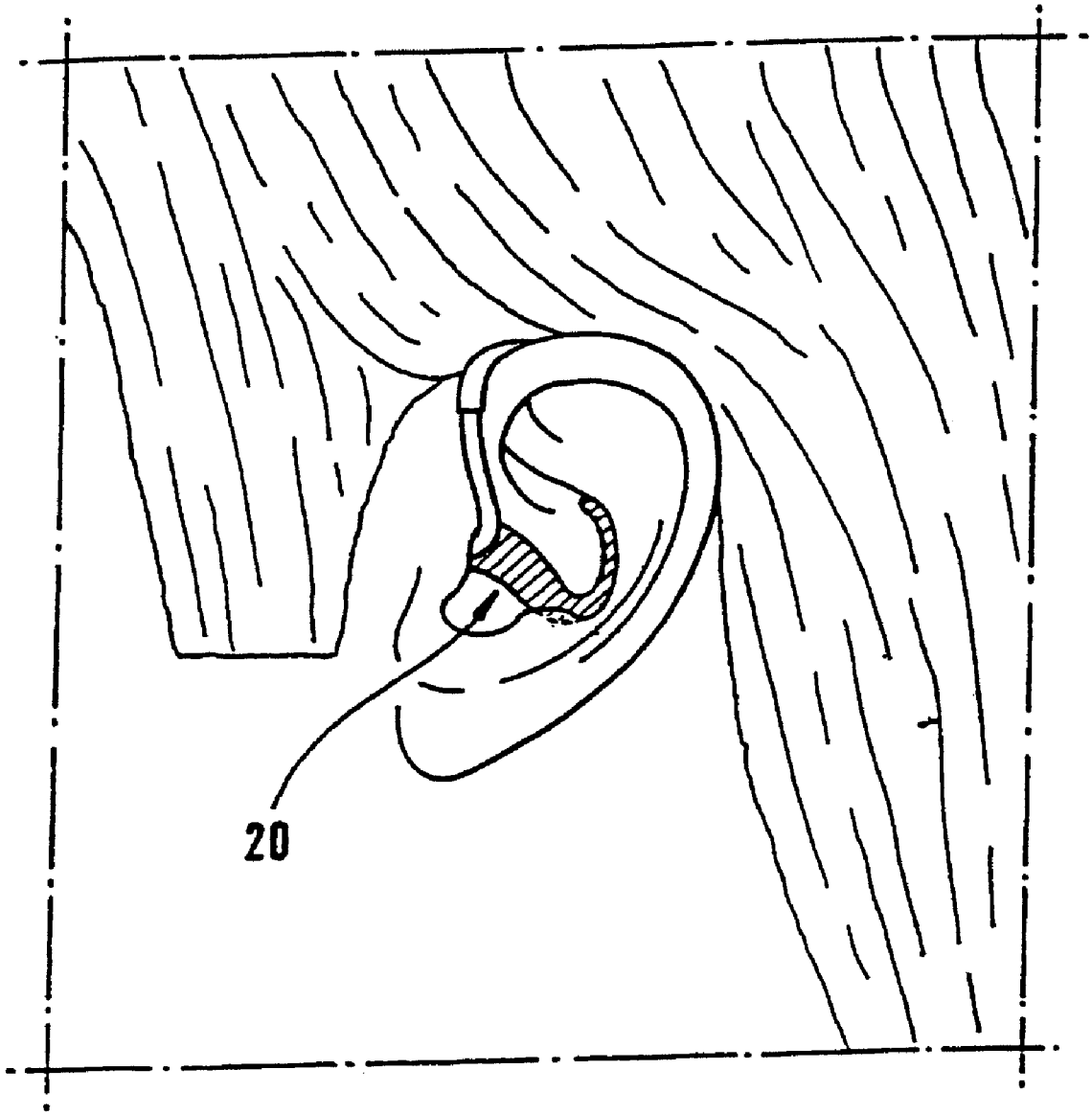
FIG. 5 is a view of an earpiece placed in an external ear, according to the construction corresponding to the first embodiment.
Figure 6:
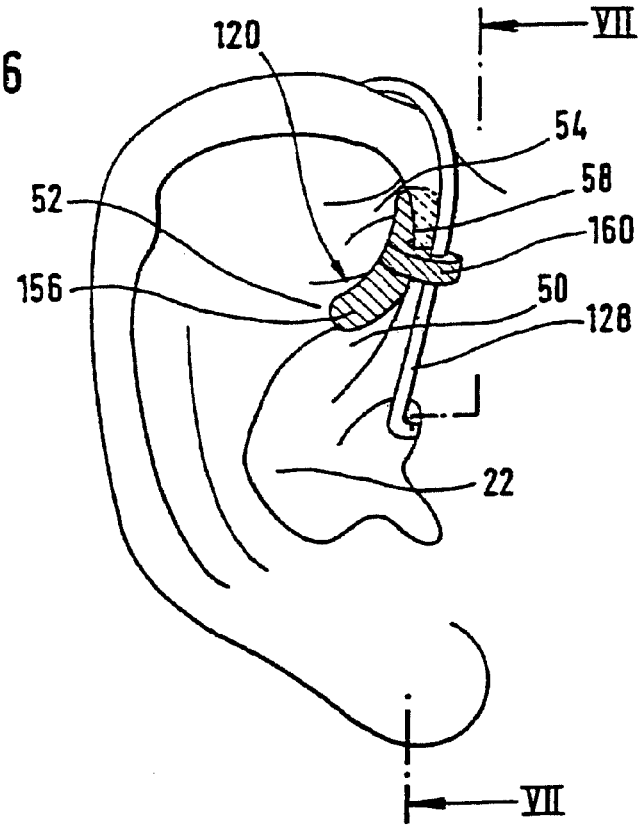
FIG. 6 is a view of an ear from the side, with the earpiece according to the second embodiment inserted in it.

The cosmetic aspect of the earpiece according to the invention is best evident from FIG. 5, in which the visible surface of the earpiece 20 is shown with hatched lines. It is obvious that the design according to the invention is such that it has practically no detrimental effect on the natural appearance of the external ear.

FIGS. 6 to 11 show additional embodiments of the earpiece according to Claim 5.

The earpiece, which again is emphasized with hatched lines, as also in FIGS. 1 and 2, is referred to with the reference number 120. It is arranged in such a way that the cavum conchae remains entirely free. Instead, the earpiece is arranged in the region of the cymba conchae 50, and, in the case shown, with an extension into the region of the crus anthelicis 52, 54.

Again, the earpiece is individually adapted to the anatomy of the patient, and consists essentially of two components, namely the part 156 that provides the hold, which is shaped to fit into the cymba conchae 50, and a hill 160, which forms the holder for the flexible sound tube 128 at its end. The sound tube 128 is inserted at an angle into the interior of the auditory canal 26, as shown in FIG. 7, and can have a so-called cerum defender 162 there, for example.

Figure 7:
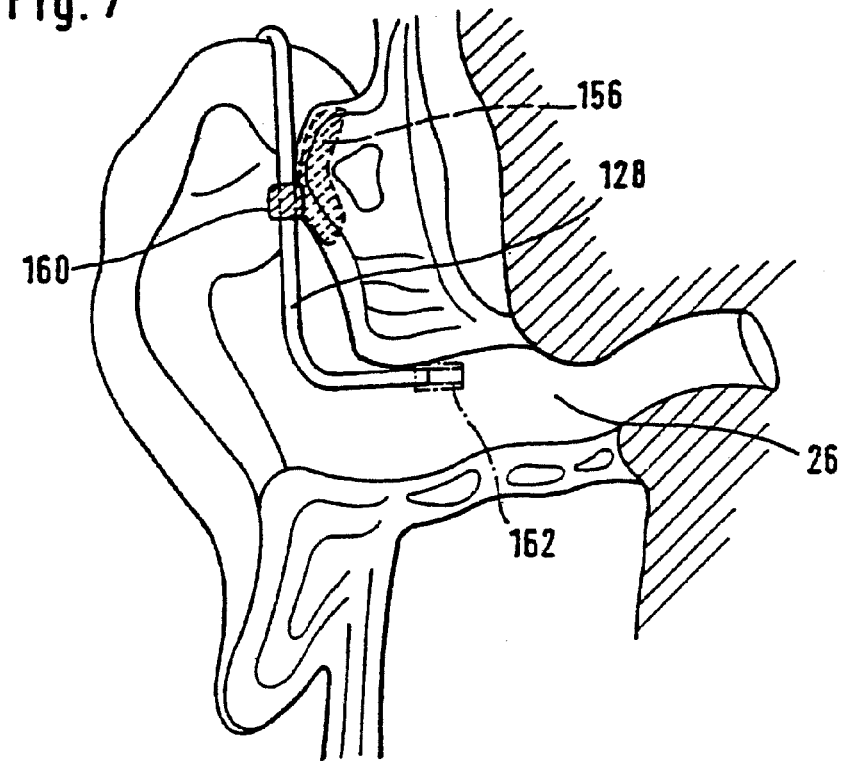
FIG. 7 is a cross-sectional view taken along line VII-VII in FIG. 6.

This embodiment of the earpiece has an even smaller structural volume than the earpiece according to FIGS. 1 to 5, and, as is evident from FIG. 7, it has almost no influence on the auditory canal.

Figure 8:
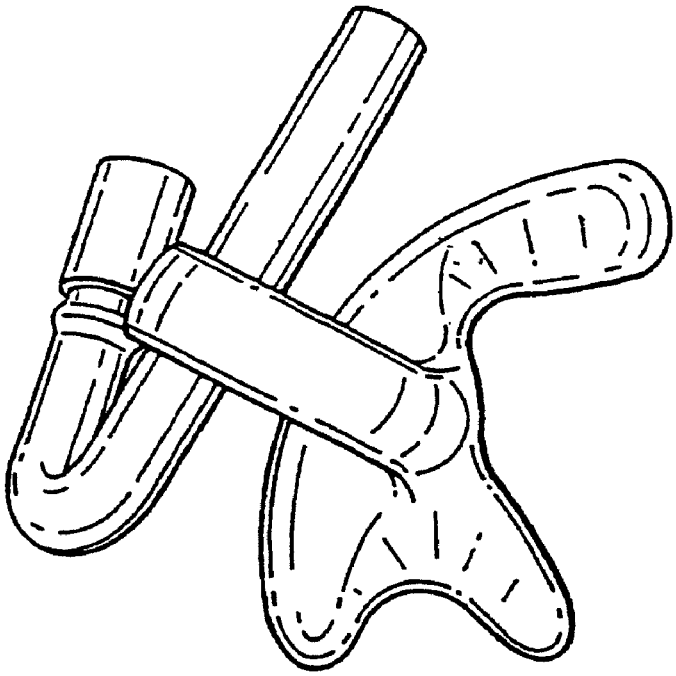
FIG. 8, and FIG. 9: on a larger scale, illustrate representations of an actual manufactured earpiece of the embodiment according to FIGS. 6 and 7.
Figure 9:
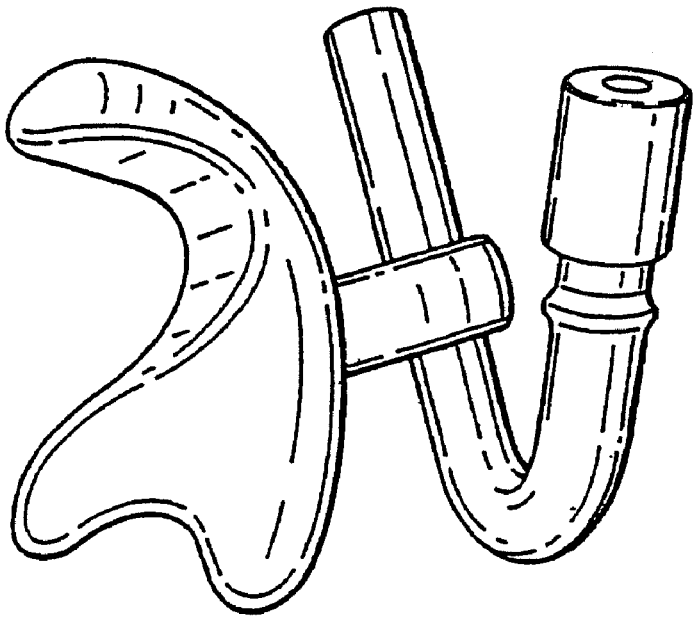

FIGS. 8 and 9 show an earpiece used in practical situations, on a larger scale. The surface structure of the main body, with its multiple curves, is clearly evident; this is responsible for the accurate fit and secure seat in the cymba conchae, which prevents it from being moved. The embodiment according to FIG. 8, 9 was produced for a patient with a rather large-volume cymba conchae.

Figure 10:
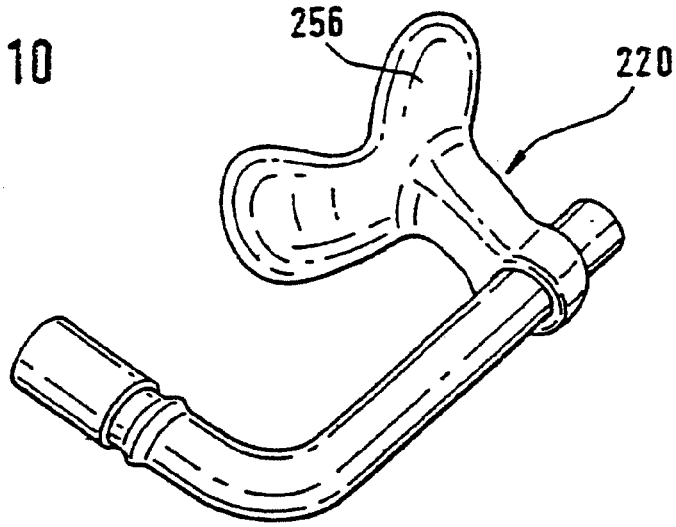
FIG. 10 is an enlarged view of another embodiment of the earpiece, with a main body of a smaller size.
Figure 11:
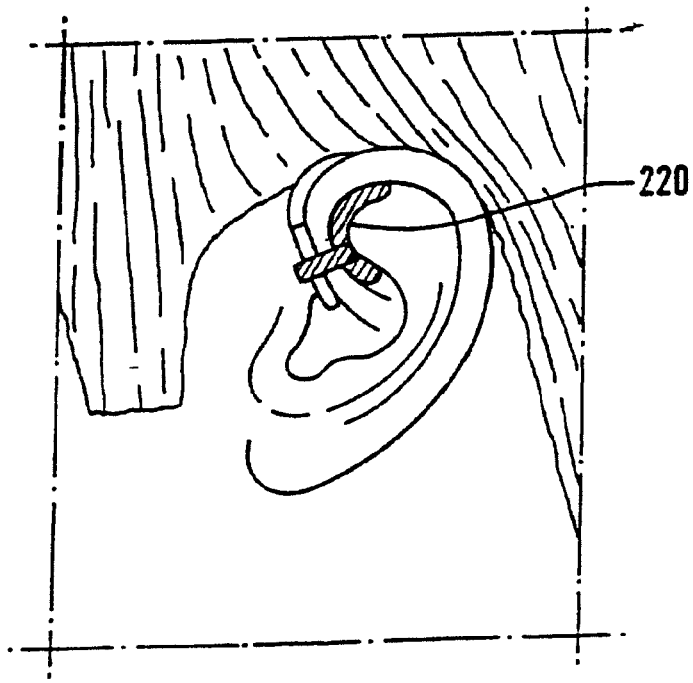
FIG. 11 is a view of an earpiece according to FIG. 10, placed in an external ear.

FIGS. 10 and 11 show another embodiment that was used for a patient with a significantly smaller cymba conchae. The earpiece, designated as 220, has a significantly smaller main body 256, which again is spatially curved in many places, so that the necessary undercut with the surface of the ear comes about.

From the view according to FIG. 11, it is evident that the visible part of the earpiece 220 is kept to a minimum.

Of course, all the usual materials can be used for the earpieces according to the invention, such as hot-polymerized and cold-polymerized PMMA or photopolymerizate. Because of the low volume of the earpiece, colored designs, possibly with jewelry-like applications, are also possible. Also, metals such as stainless steel, gold, silver, platinum, titanium (injection-molding or spin-casting process) can be used, and it is also possible to work with galvanic technology.

FIGS. 12 to 15 show a variant of the earpiece according to FIGS. 1 to 5. In order to simplify the description, those components that correspond to the components of the earpiece according to FIGS. 1 and 2 are provided with the same reference numbers, but with a 3 preceding them.

In contrast to the structure according to FIGS. 1 and 2, the clip of the earpiece 320 is modified in such a way that it essentially has the shape of a Euro-E. The shank 332 that follows the edge of the cavum conchae 322 is extended beyond an angled location 370 for the traverse segment 334 and runs along the anthelix 362, so that it forms another shank 364 there. The hatched areas indicate that the individual shanks make a transition into each other via roundings 332A.

Figure 12:
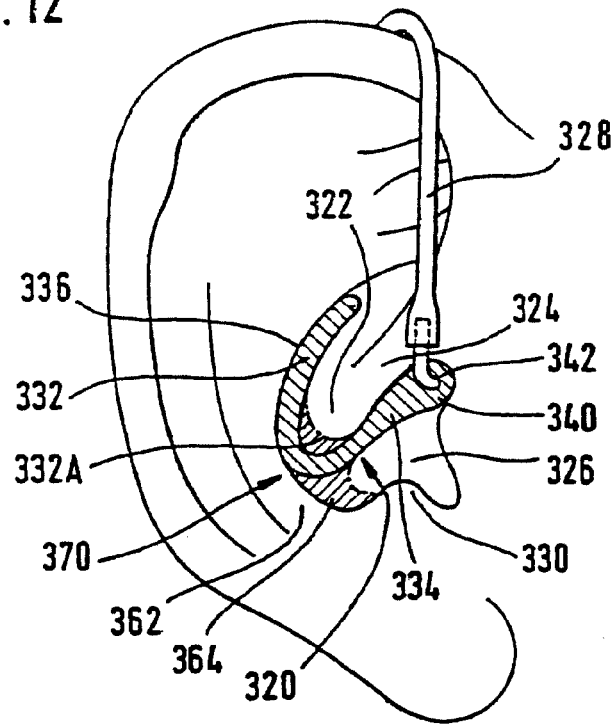
FIG. 12 a view of a variant of the earpiece according to FIG. 1 to 5, corresponding to FIG. 1.
Figure 13:
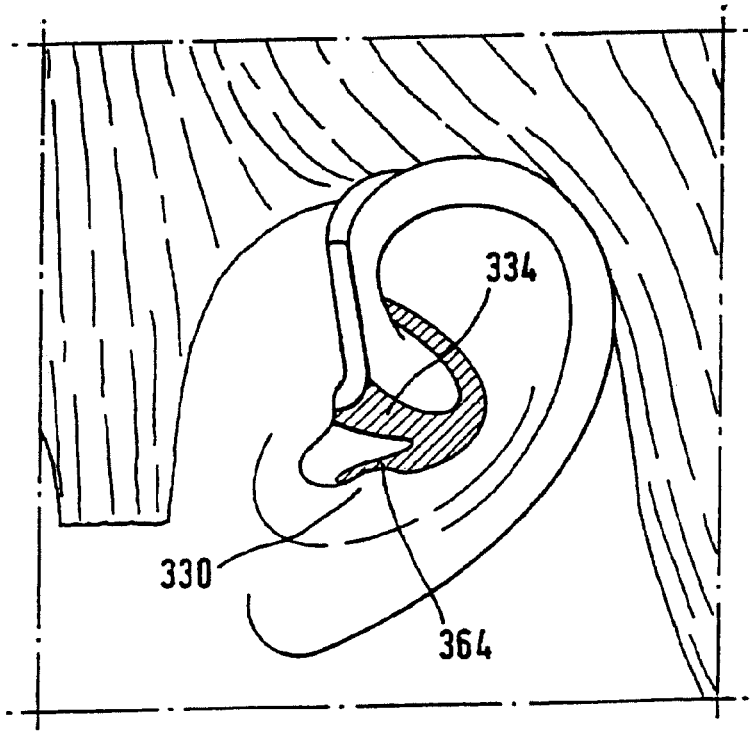
FIG. 13 a view of the earpiece according to FIG. 12.

As a variant to FIG. 12, FIG. 13 shows that the additional shank 364 is extended to a location behind the antitragus 330.

Figure 14:
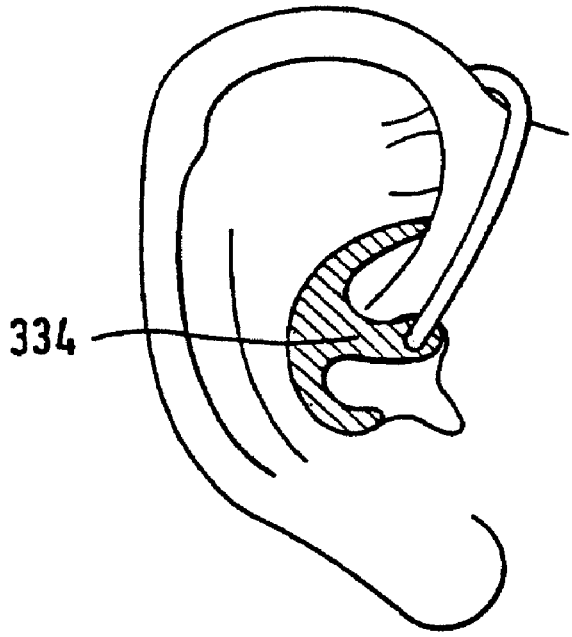
FIG. 14 a view of a modification of the earpiece according to FIG. 12.
Figure 15:
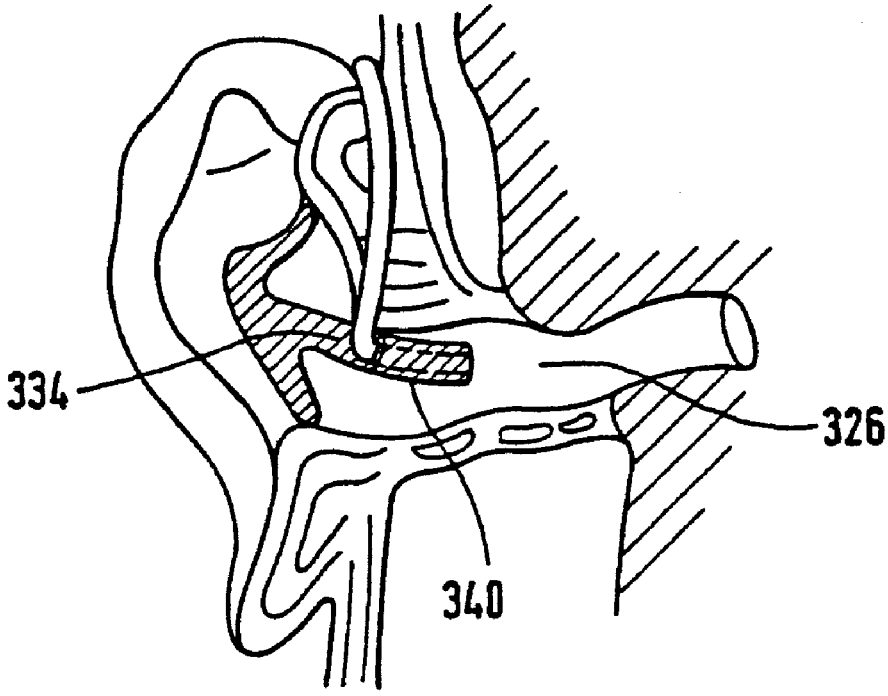
FIG. 15 a cross-sectional view of the embodiment according to FIG. 14.

FIGS. 14 and 15 explain the modification of the earpiece once again, using representations that correspond to the views of FIGS. 1 and 2. It is evident that also in this embodiment, the shank 334 that forms the traverse segment makes a transition to an end segment 340, which is connected in one piece with the auditory canal tab 340. The auditory canal tab 340 in turn is placed in the upper region of the auditory canal 326, without making contact.

Figure 16:
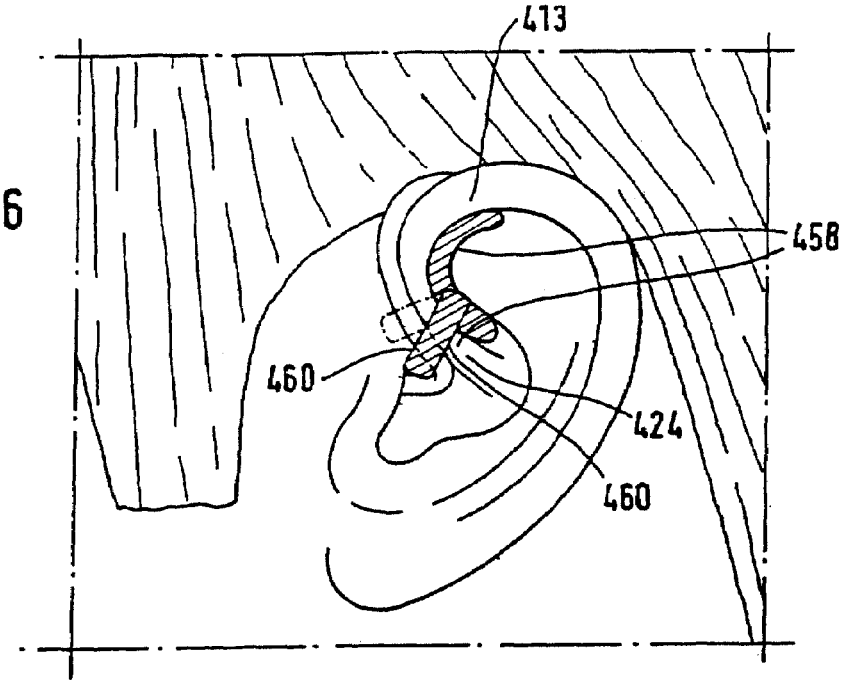
FIG. 16 a view of a further development of the earpiece according to FIG. 6 to 11, corresponding to FIG. 11.

FIG. 16 illustrates a possibility of structuring the earpiece according to FIGS. 6 to 11 with regard to anatomically optimized stabilization of the sound tube in the region of the entrance to the auditory canal. Here again, for the sake of simplifying the description, the same reference numbers are used for segments and components that have an equivalent in FIGS. 6 to 11, with a 4preceding them.

It is evident that the clip 460 that goes around the edge 458 of the external ear in the shape of an arc has been pivoted downward from the position shown with a dot-dash line, so that it practically bridges the top segment of the crus helicis 424.

Figure 17:
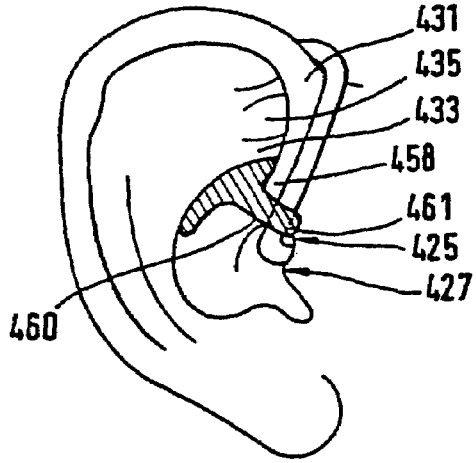
FIGS. 17 and 18 views of a first embodiment of the earpiece according to FIG. 16.
Figure 18:
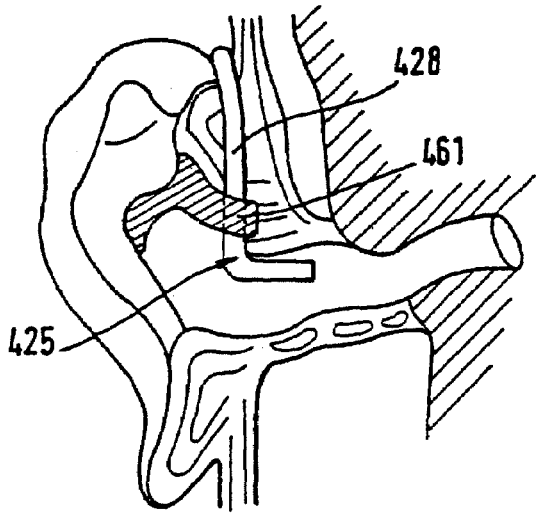
Figure 19:
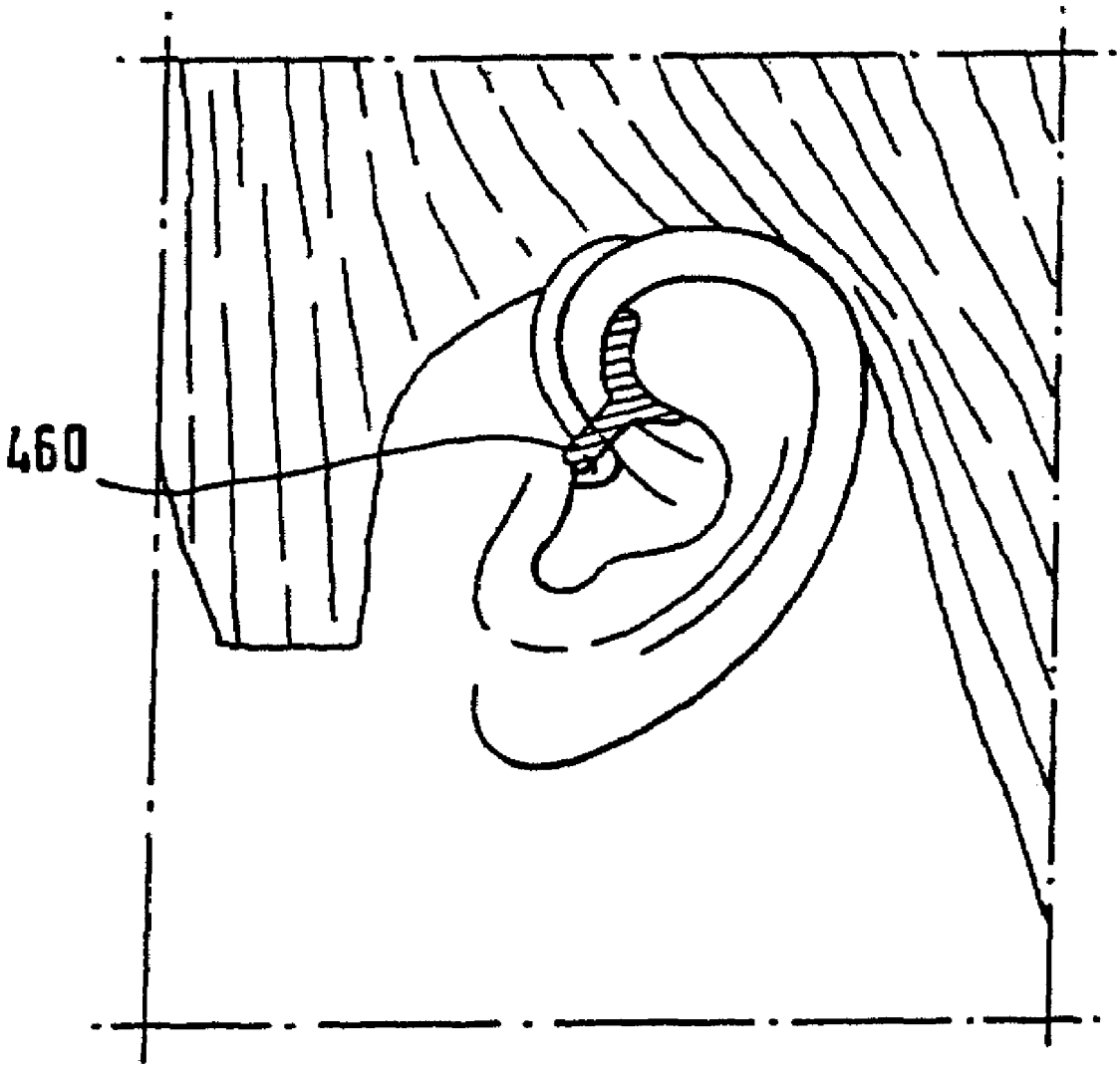
FIG. 19 a view of the earpiece according to FIGS. 17 and 18, similar to FIG. 13.

FIGS. 17 to 19 show a first embodiment of this modification. The reference number 461 refers to a sound tube eye that stabilizes a sound tube 428. The arrangement is designed in such a way that the sound tube eye 461 is located directly above the incisura anterior 425, i.e. between the tragus 427 and the crus helicis 424.

For the remainder, the embodiment corresponds to that according to FIGS. 6 to 11, i.e. half of the earpiece body is located in the cymba, while the other half can run below the helix 431 via the crus inferior anthelicis 433 in the direction of the fossa triangularis 435. This is shown in FIG. 19, for example.

Figure 20:
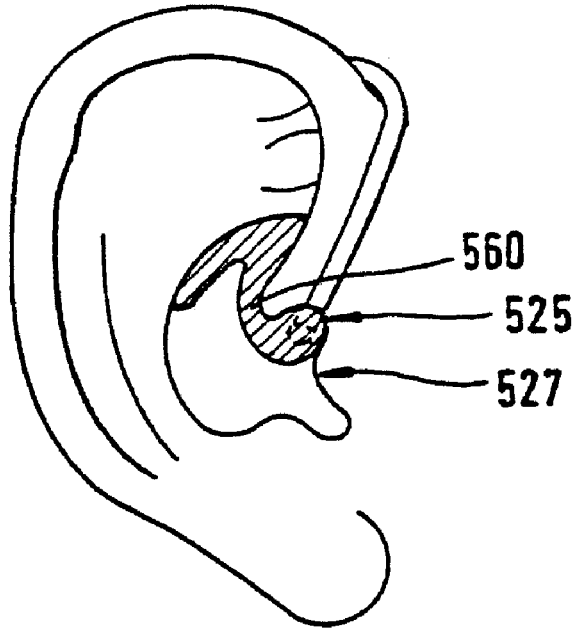
FIGS. 20 and 21 views of a second embodiment of the earpiece according to FIG. 16.
Figure 21:
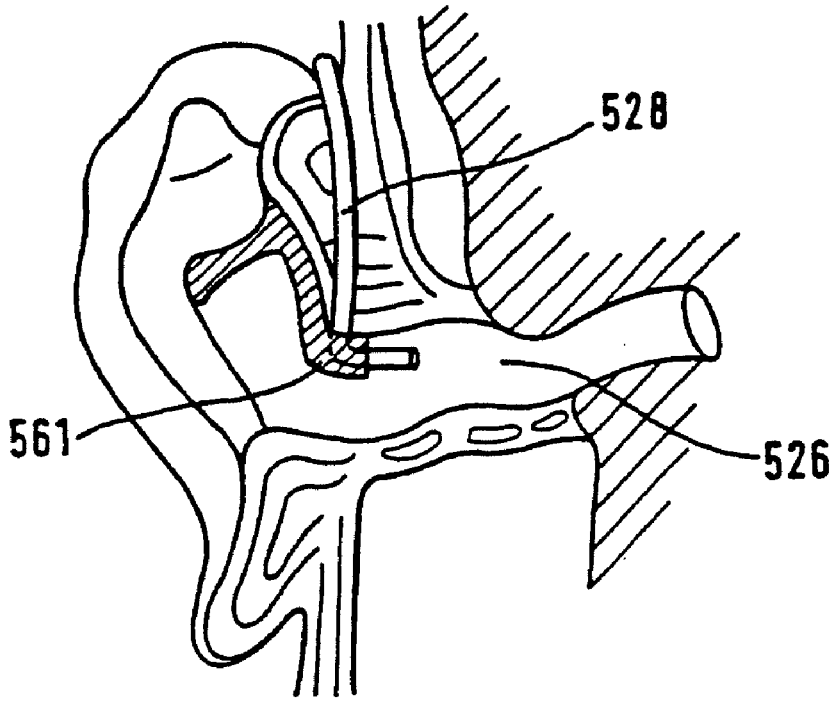

A second variant of the modified embodiment of the earpiece according to FIG. 16 is shown in FIGS. 20 and 21. Here again, for the sake of simplifying the description, the same reference numbers are used for segments and components that have an equivalent in FIGS. 17 to 19, but with a 5preceding them.

Here, the arrangement is designed in such a way that a holder 561 for the sound tube 528 is recessed between the incisura anterior 525 and the tragus 527, in the entrance region to the auditory canal 526. The clip 560 runs at an even steeper angle than in the embodiment according to FIGS. 17 to 19.

Since the entrance region to the auditory canal, particularly in the first third of the auditory canal, is reduced in size with this variant of the sound tube mantling, there are corresponding shifts in the OEG resonance. In addition, it must be noted that the material coverage around the region of the crux helicis requires sensitive impression-taking or targeted work on the impression of this region.

Figure 22:
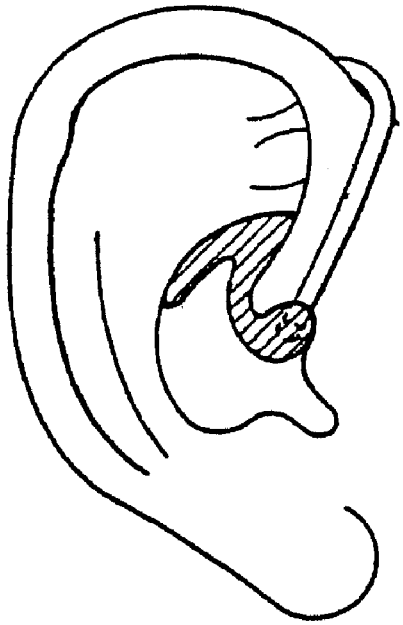
FIGS. 22 and 23 views of a third embodiment of the earpiece according to FIG. 16.
Figure 23:
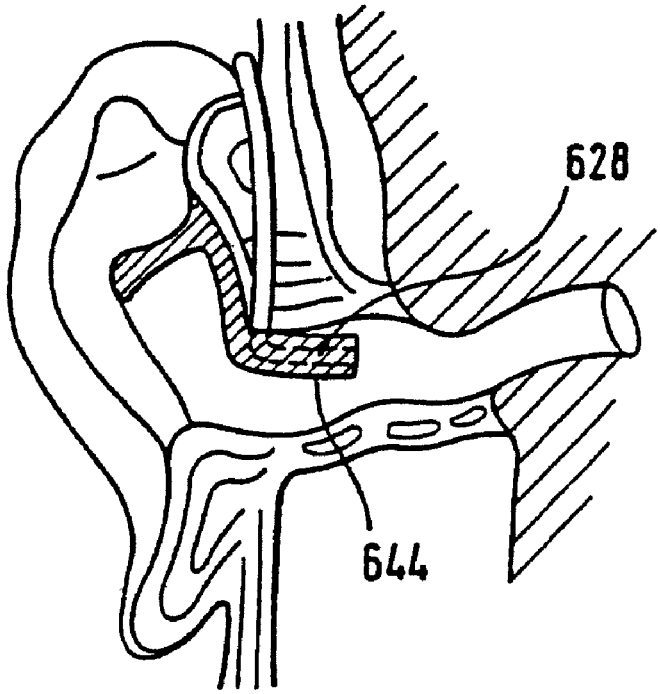

A second embodiment of the modified version of the earpiece according to FIG. 16 is shown in FIGS. 22 and 23. Here again, to simplify the description, the same reference numbers are used for segments and components that have an equivalent in FIGS. 6 to 11, with a 6preceding them here.

The difference as compared with the variant according to FIGS. 20 and 21 is that the sound tube holder is formed by an auditory canal tab 644 arranged without making contact in the upper region of the auditory canal, which holder surrounds the sound tube 628 or an angled piece of the earpiece.

Figure 24:
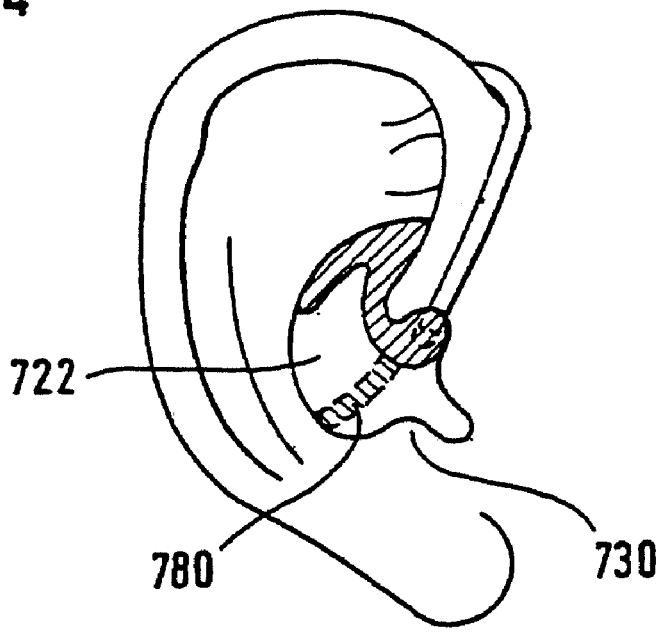
FIGS. 24 and 25 views of a variant of the third embodiment of the earpiece according to FIGS. 22 and 23.
Figure 25:
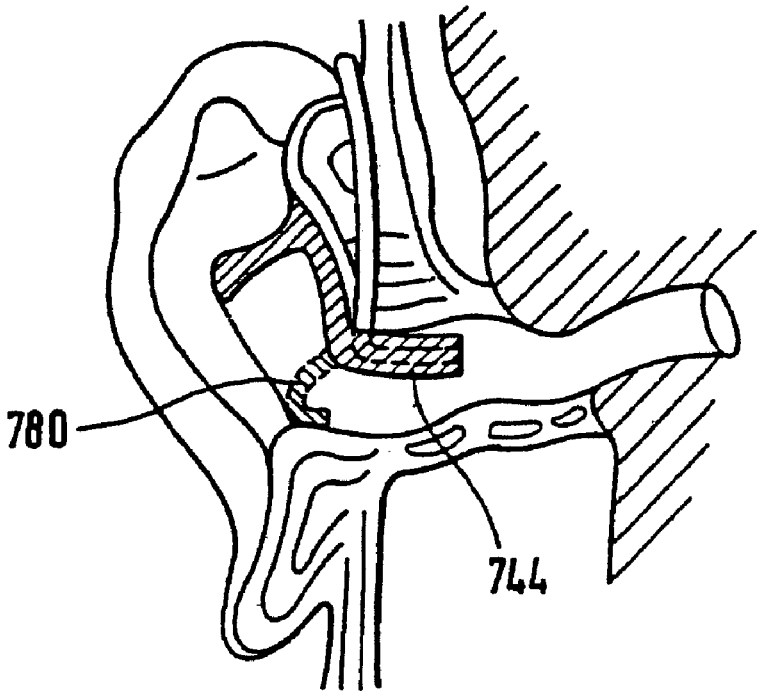

Finally, FIGS. 24 and 25 show a modification of the variants of FIGS. 20 to 23, in such a way that further improvement of the stabilization of the earpiece is a result. The sound tube holder 744 is stabilized by way of a support claw 780, shown with hatched lines, which extends from the bottom of the sound tube holder 744 in the direction of the antitragus 730, molding itself against the concha 722.

The invention claimed is:

1. An earpiece for behind-the-ear parts of a hearing acoustic device, by means of which a flexible sound tube is positionable in an auditory canal of a patient, which comprises:

an earpiece holding portion which is adaptable to an ear of the patient wherein the holding portion is held in a cymba portion of the ear, countersunk and fitted in place, and has a clip member that passes over an edge portion of the external ear in a shape of an arc, wherein an end of said clip forms a holder for the flexible sound tube.

2. An earpiece according to claim 1, wherein the clip is broadened at an end portion thereof and forms an eye portion of a sound tube.

3. An earpiece according to claim 1, wherein the holding portion is extendable into a crus anthelicis region of the ear.

4. An earpiece according to claim 2, wherein the holding portion is extendable into a crus anthelicis region of the ear.

5. An earpiece according to claim 1, wherein said earpiece is configured for use with cochlear implant microphones or CI BTE processors, with BTE tinnitus systems.

* * * * *